US005806117A

United States Patent [19]

Gotfried

[11] Patent Number: 5,806,117

[45] Date of Patent: Sep. 15, 1998

[54] HEIGHT-ADJUSTABLE SUPPORT FOR LOWER-LIMB OPERATIONS

[76] Inventor: Yechiel Gotfried, 10, Ben Gurion Ave., Kiryat-Bialik, Israel

[21] Appl. No.: 651,234

[22] Filed: May 22, 1996

[30] Foreign Application Priority Data

Mar. 4, 1996 [IL] Israel ..... 117345

[51] Int. Cl.[6] ..... A61G 13/12; A61G 13/00; A61G 13/10

[52] U.S. Cl. ..... 5/624; 5/621; 5/601

[58] Field of Search ..... 5/621–624, 646–650, 5/601

[56] References Cited

U.S. PATENT DOCUMENTS

| | | | |
|---|---|---|---|
| 988,923 | 4/1911 | Bauerfeind | 5/623 |
| 2,200,541 | 5/1940 | Chick | 5/624 |
| 2,801,142 | 7/1957 | Adams | 5/624 |
| 3,046,072 | 7/1962 | Douglass, Jr. et al. | 5/623 |
| 3,353,820 | 11/1967 | Langren | 5/621 |
| 4,564,164 | 1/1986 | Allen et al. | 5/621 |
| 4,886,258 | 12/1989 | Scott | 5/624 |
| 5,276,927 | 1/1994 | Day | 5/622 |

*Primary Examiner*—Alexander Grosz
*Attorney, Agent, or Firm*—Frishauf, Holtz, Goodman, Langer & Chick, P.C.

[57] ABSTRACT

A limb support is attached to an operating table for the purpose of supporting the upper portion of a lower extremity during operation of a fracture. It includes an oblong, slightly concave body of a material transparent to X-Ray photographs and can be placed in any position in regard to the operation table by being mounted on top of a hand-operated jack. The jack is attached to one end of a horizontal bar which can be moved both in angular and longitudinal directions about its connection to the table by means of a clamp connector, permitting its remaining in position during any required movement of the table.

18 Claims, 6 Drawing Sheets

HEIGHT-ADJUSTABLE SUPPORT FOR LOWER-LIMB OPERATIONS

The invention relates to an auxiliary medical device for support of a lower limb during an operation such as connecting a fracture of a hip joint or a femoral bone. It relates particularly to a device serving to raise and to support the buttock of a patient during connection of a fractured femur neck.

BACKGROUND OF THE INVENTION

Connecting a fractured bone of a lower limb by means of screws and plates requires first of all the assembly of the fractured bone portions into their normal position in order to permit subsequent drilling and connecting the fractured bone parts by the above connecting means. In order to carry out the operation the patient is laid on his back on an operation table 200 (FIG. 6) with his feet placed into traction means 202, 204 configured to pull the legs downwards against a support 206 placed at the crotch between his legs. This is necessary for the reason that after a fracture of femur the contracting muscles will pull the leg in an upward direction, causing the fractured portions to be dislodged relative to each other. Before start of the operation they have to be brought into their original position with the fractured surfaces closely fitting onto each other. In addition to the fractured portion being pulled upwards it is a common experience that the upper part sags from the patient's prone position, requiring its raising to obtain a perfect fit. In the case of a fractured femur neck the body portion to be raised is the lower part of a buttock. The conventional method of raising and supporting the upper limb portion includes a crutch or stand with a plate on top which can be raised or lowered by hand in accordance with the patient's position as shown by an X-Ray image. This solution is rather primitive, besides being a nuisance for the personnel having to adjust a new position whenever the height of the operating table has to be changed. Its other drawback is that it obstructs motioning the X-Ray imaging apparatus underneath the operating table.

It is, therefore, the main object of the present invention to provide a limb support which will not obstruct X-Ray imaging or hinder the movement of the arm of the X-Ray apparatus.

It is another object to provide a limb support adapted for attachment to the operating table instead of standing on the floor, which would require frequent height adjustment in accordance with raising or lowering of the operating table as required by intraoperative actions.

And it is a final object to provide a limb support that can be readily brought into any position required for supporting a body part, to be raised or lowered without effort to the exact height required and to be maintained in this position.

SUMMARY OF THE INVENTION

The device for raising and supporting a portion of tile human body during an operation and during X-Ray-imaging essentially includes a limb-support of a material transparent to X-Ray radiation mounted on top of a hand-operated jack which is attached to a side rail of an operating table by means which permit its positioning underneath any portion of the patient lying on the table. The jack is preferably a screw jack but may be of the pawl-and-ratchet type. According to the invention the jack comprises a vertical screw or ratchet movable in vertical and rotary direction in a housing which is attached to the end of a substantially horizontal bar, the latter being slidingly secured in a bracket. The bracket is attached to a conventional connector which is slidingly connected to the side rail of the operating table. The connector is in the shape of a clamp configured to grip a vertical rod extending from the bracket in upward direction and permitting swinging of the bracket—and the secured bar—about a complete circle. The bracket is preferably a horizontally aligned, slotted sleeve which permits longitudinal motion of the bar and its clamping in the required position by screw means on the sides of the slot. The limb support fixed to the top of the jack is of a translucent material transparent to X-ray and other radiation used in photo-imaging of the fractured bones. It has its one end firmly attached to the screw or ratchet of the jack and its main portion is slightly concave with the aim to fitting the body contours.

The housing of the jack may be slotted by a vertical slot which can be tightened on the screw or ratchet by means of a screw and two lugs on both sides of the slot for the purpose of firmly holding the ratchet bar or screw at the required level and at the required angular alignment.

As an alternative the jack may comprise a vertical bar slidingly mounted in a vertically bored housing. The bar is perforated by a plurality of horizontal bores which serve to maintain the bar at the required level by means of a pin configured to be pushed into one of the bores through a similar bore in the housing.

Still another embodiment of the jack includes a smooth cylindrical bar vertically movable in a vertically slotted housing and carrying a limb support rigidly fastened to its top. The bar and the limb support are manually movable into vertical and angular alignment underneath the body portion to be supported, and the bar is clamped in the slotted housing by narrowing the slot by means of two lugs on both sides of the slot pulled together by a screw.

DETAILED DESCRIPTION OF THE DRAWINGS.

Figures 1, 1A:
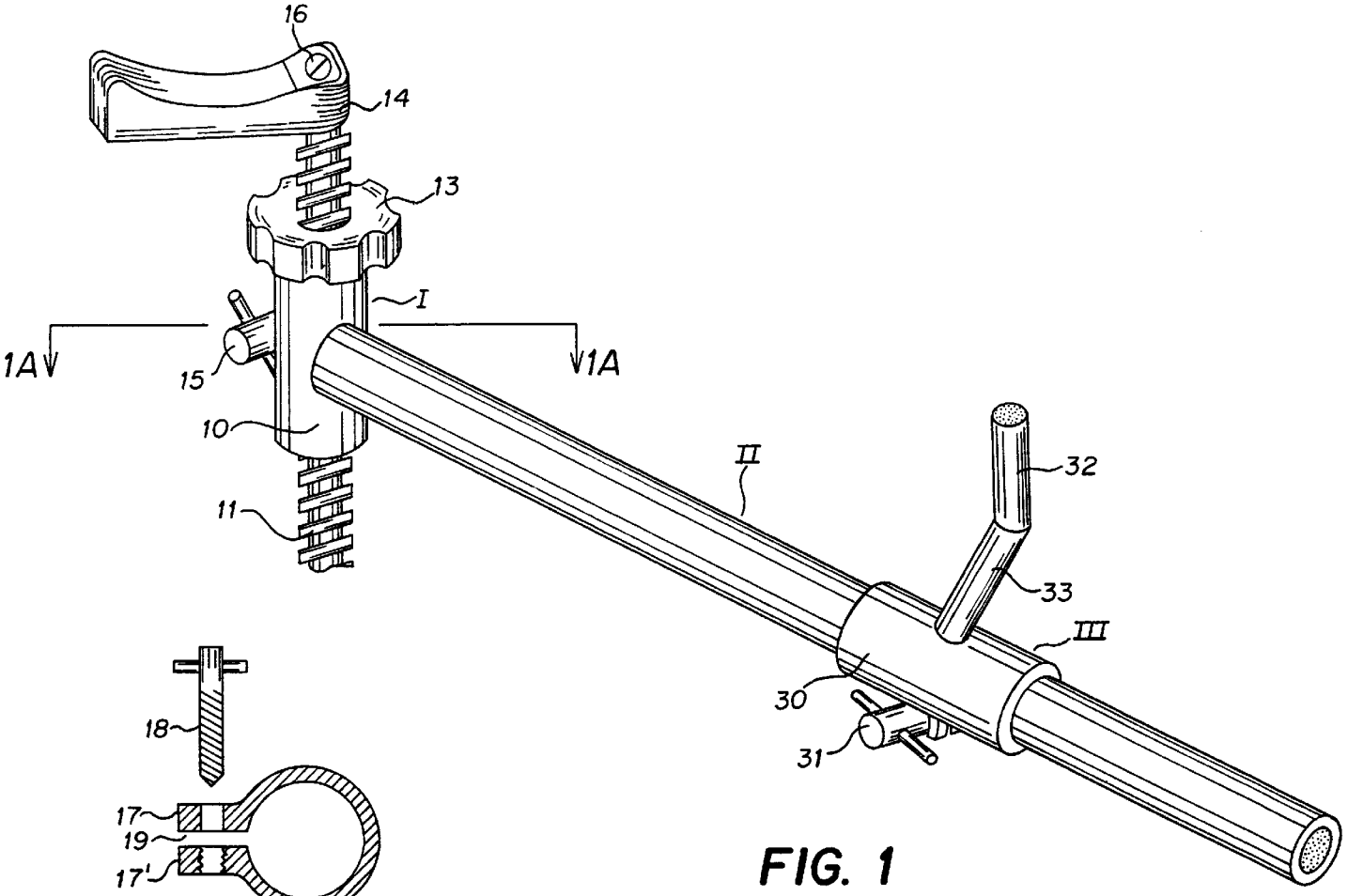
FIG. 1 is an isometric view of the device including a Screw-jack attached to a slide bar which is mounted in a slotted racket.
FIG. 1A is a section along line 1A–1A of FIG. 1.

The device illustrated in FIGS. 1 and 1A includes a screw jack I attached to the end of a horizontal bar II, while the latter is held in position in a bracket III. The jack comprises a vertical cylindrical housing 10 provided with a co-axial smooth bore which encloses a screw 11. The screw is configured to be moved up or down in the housing by means of a nut 13 positioned on top of the housing and having a serrated rim facilitating gripping and rotating it. The top end of screw 11 engages a co-extensive bore in the end portion of a limb support 14 which is firmly connected thereto by a screw 16. The limb-support has a slightly concave top surface to fit the supported body portion, such as a buttocks. It is made of a material transparent to X-Ray or other radiation used for imaging of the body portion under treatment. Before start of the operation the limb-support is raised to the required level by means of nut 13 and rotated, together with the screw, to fit the of the limb—such as a buttock—, whereafter the screw is firmly secured in the housing by clamping. For this purpose the housing is vertically slotted, as shown in FIG. 1A by a slot 19 which is to be narrowed and pressed onto the screw by means of two lugs 17 and 17' and a winged screw extending through perforations in the lugs. As can be seen in FIG. 1A, lug 17' has a threaded bore co-extensive with the thread of screw 18, while lug 17 has a smooth bore permitting passage of screw 18. The housing is firmly attached to the end of bar 11 which—in the present case—is in the form of a tube but could be in any other shape. It is held in a bracket III in the form o a tube 30 which is longitudinally slotted along its bottom portion for the purpose of securing the bar II in firm location by closing the slot by means of two perforated lugs and a screw 31. The bracket is further provided with a vertical rod 32 extending from the bracket by a bend 33. It is configured to be clamped and held in firm position by a clamp connector 208 (FIG. 1) slidingly movable along the side rail 210 of the operating table, as known to the art. After positioning of the jack underneath the respective body portion, both in angular as well in longitudinal direction, bar II is held in position by clamping it firmly in bracket III, as well as by tightening the clamp connector on rod 32.

Figure 2:
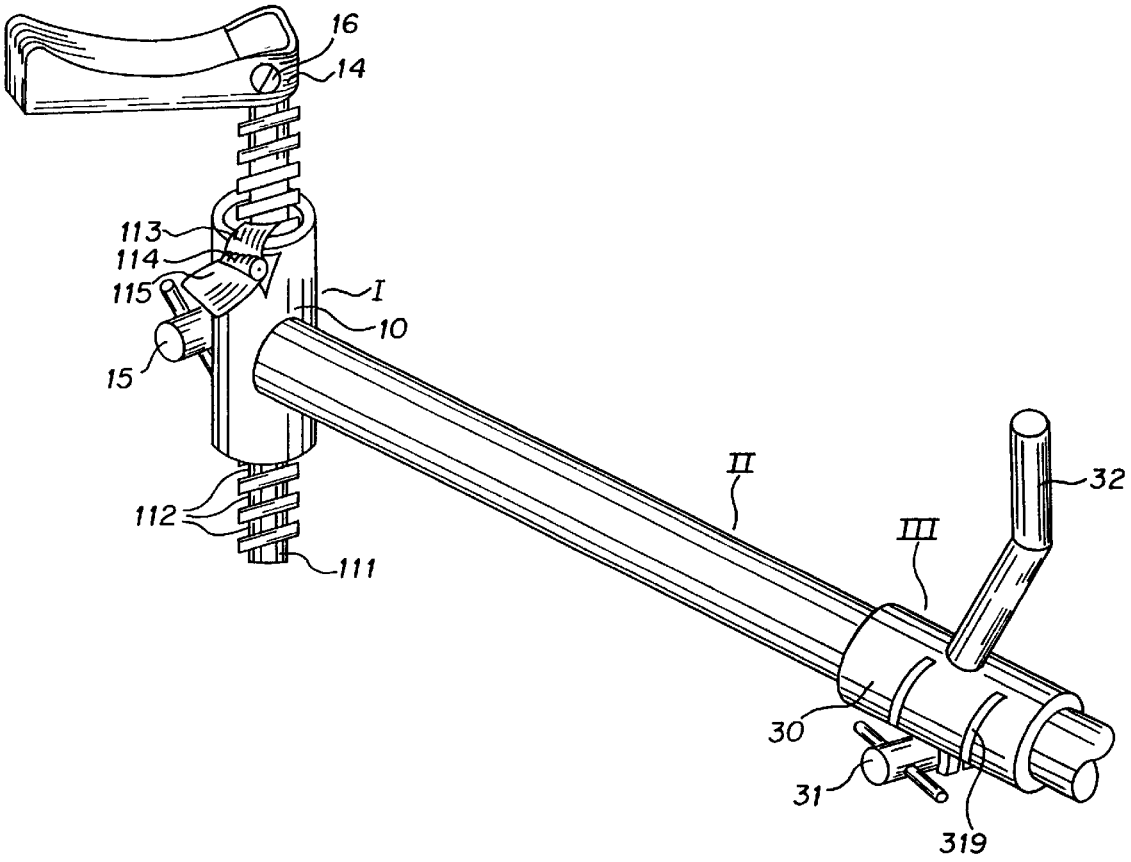
FIG. 2 is an isometric view of the device including a Jack featuring a pawl and ratchet mechanism.

FIG. 2 illustrates a substantially identical device featuring a modification of the jack I. Herein the screw 11 of FIG. 1 is replaced by a ratchet 111 in the shape of a cylindrical bar provided with a plurality of spaced-apart circumferential slots 112. The top of the bar is firmly connected to limb support 14 and secured by a screw 16 similar to the device of FIG. 1. In this embodiment the ratchet and the limb support 14 air raised by hand thereby lifting the respective fractured bone portion into correct position. The ratchet is secured in the chosen position by means of a pawl 113 urged into the respective slot by a spiral spring 114. The ratchet can be lowered by release of the pawl by pressure on the grip 115. The ratchet is enclosed in a housing 10 which is substantially identical with the housing of the embodiment of FIG. 1; it is vertically slotted (not visible), and the slot can be closed by means of lugs and screw 15 thereby tightening the housing on the ratchet bar.

FIG. 2 further shows a modification of bracket III which facilitates clamping of the bracket onto bar II. In this embodiment the lower portion of the cylindrical bracket body 30 is slotted by two slots 319 which extend perpendicular to the axis of the body. These slots serve to divide the bracket body into a central portion which is longitudinally slotted similar to the slot in the bracket of FIG. 1, while the outer portions remain whole and serve as guides only. The central portion is provided with lugs which are pulled towards each other by screw 31 thus closing the slotted portion onto bar II and clamping the bracket in the position required by the limb support 14. It is evident that less force is required to clamp a shorter section than the long cylinder of FIG. 1, permitting any nurse to close the screw and to fix the support in position underneath the limb to be supported.

Figure 3:
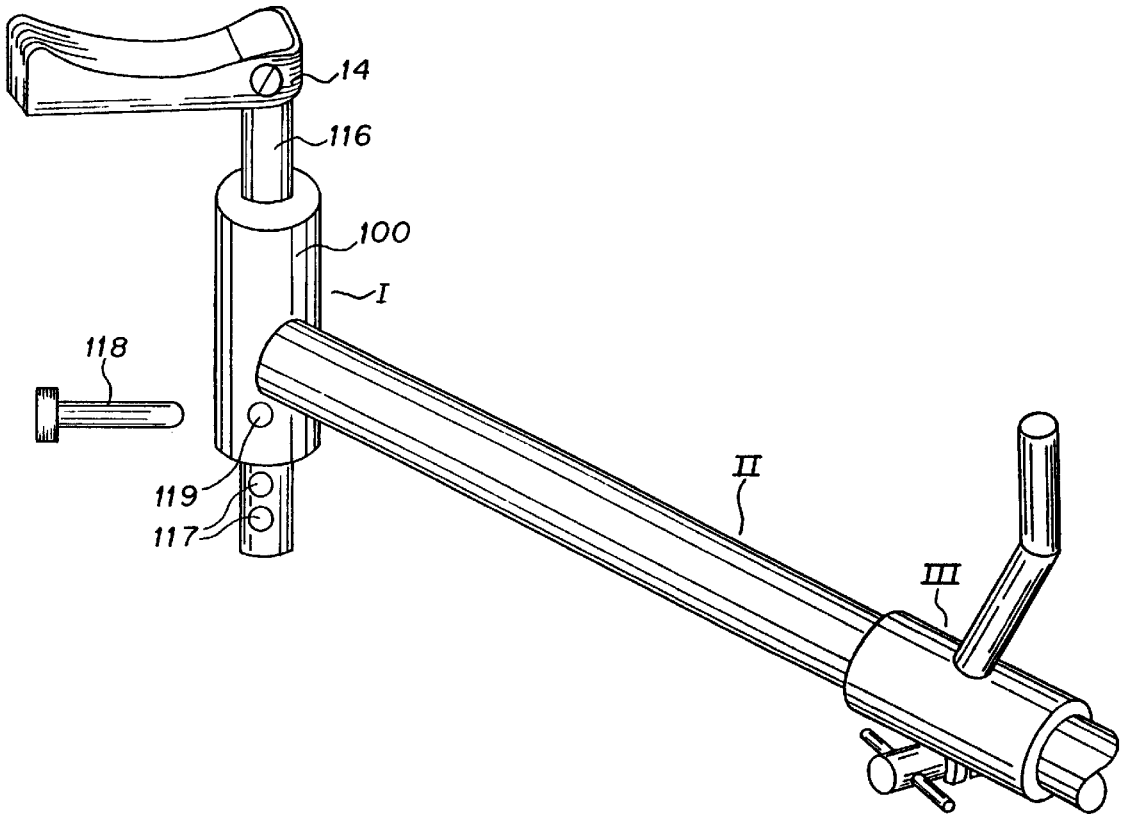
FIG. 3 is an isometric view of the device featuring a jack including a perforated bar.

FIG. 3 illustrates a third embodiment of the jack I including a smooth cylindrical bar 116 supporting the limb support 14 in a manner as described in the foregoing. The bar is perforated by a number of spaced apart bores 117 which at the correct height secure the bar, the support and the fractured bone portion in correct position by means of a pin 118 placed into one of bores 117 through a corresponding bore 119 in housing 100.

Figure 4:
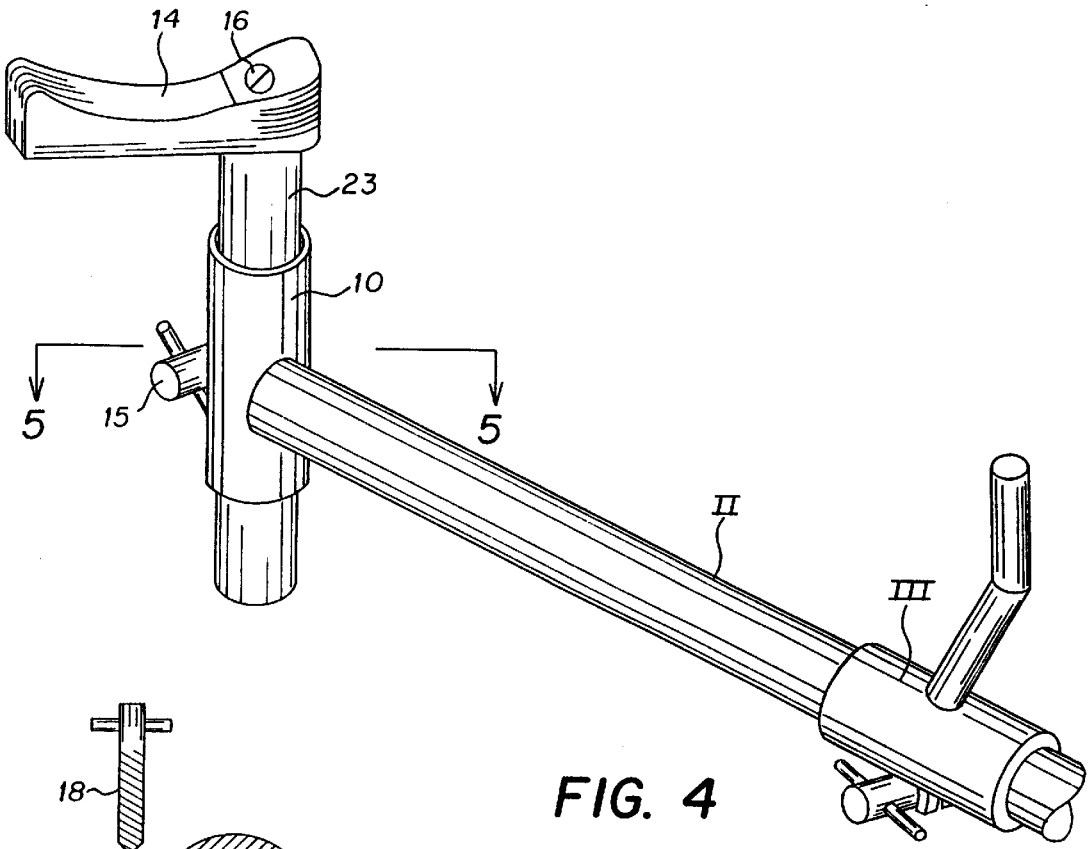
FIG. 4 is an isometric view of the device featuring a jack with a smooth cylindrical lifting bar.
Figure 5:
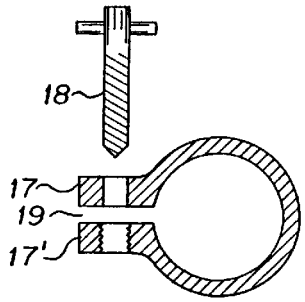
FIG. 5 is a section along line 5—5 of FIG. 4.
Figure 6:
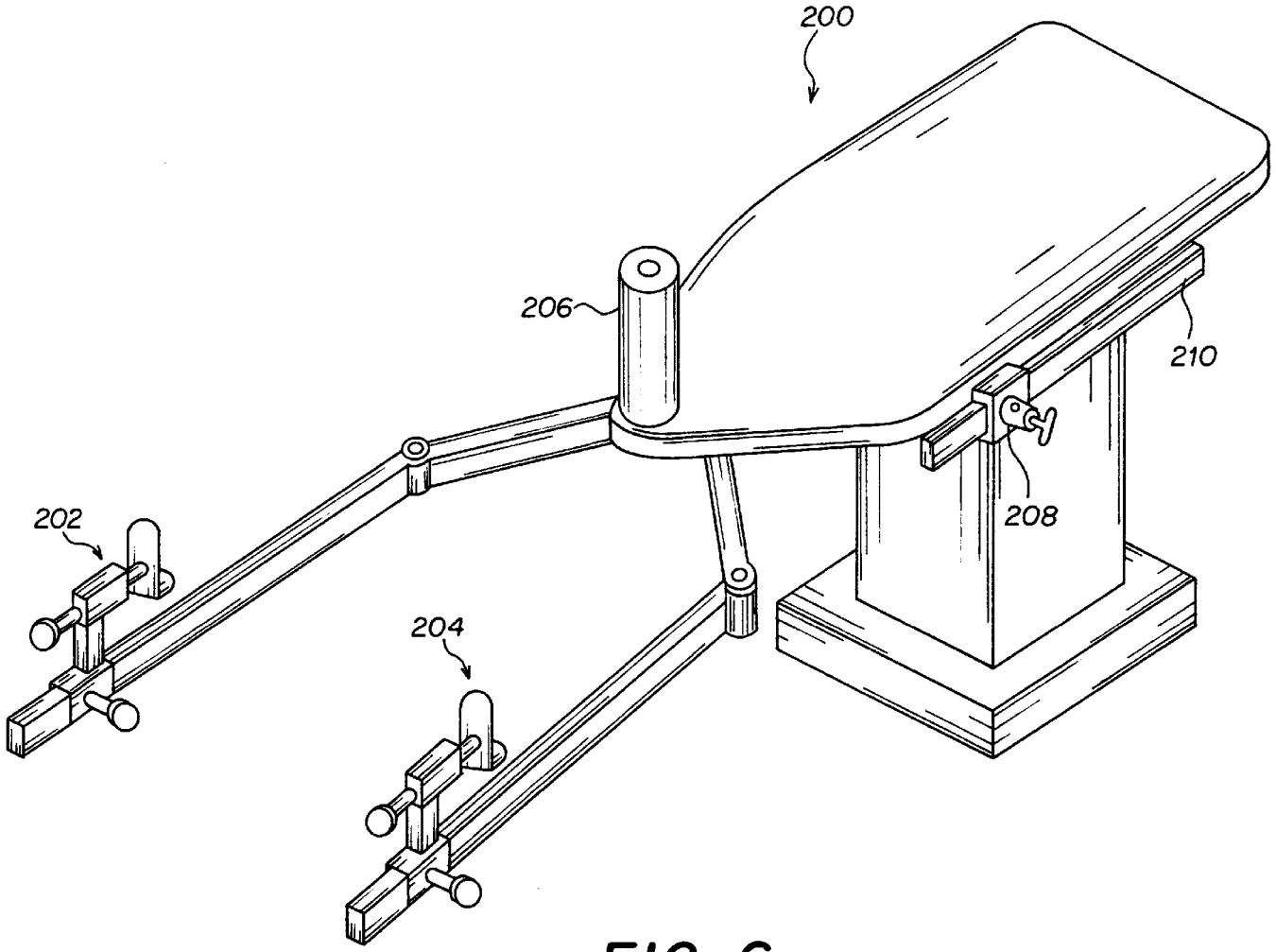
FIG. 6 (PRIOR ART)
FIG. 6 is an isometric view of a prior art operation table.
Figure 7:
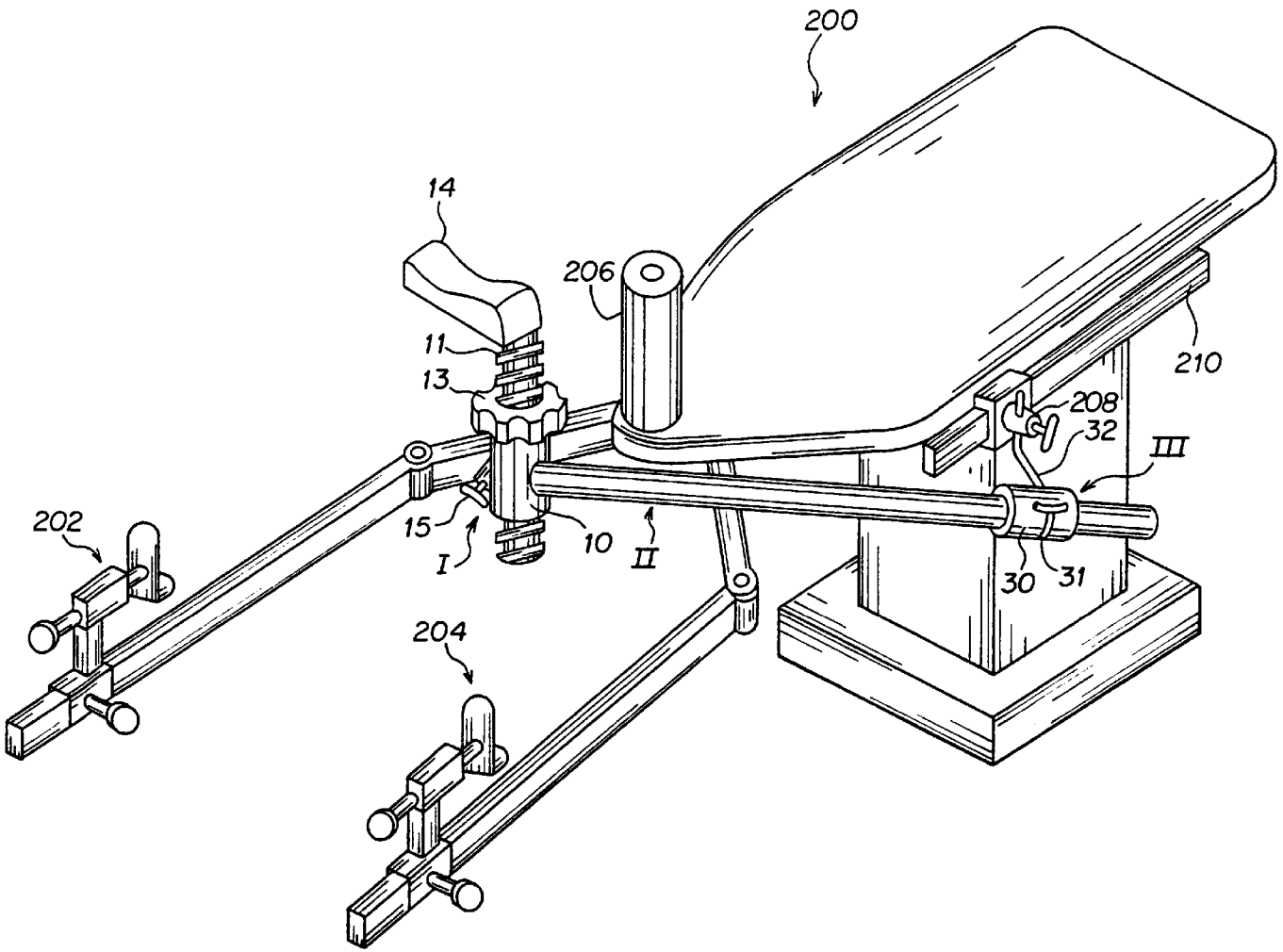
FIG. 7 is an isometric view of an operation table outfitted with the invention.

A further embodiment of the device is shown in FIG. 4 which includes a smooth bar 23 manually movable in vertical and rotational direction in a housing 10. In all other respects all components are identical with those of the embodiment of FIG. 1 except for the screw and nut.

It will be understood that the jack, the bar as well as the bracket as shown and described herein before may be modified as long as they can be suitably employed to support a limb or body portion in the correct position and at the correct height, provided the device is configured to be attached to one of the conventional connector clamps on the side rail of the operating table, and provided that it leaves free floor space underneath the table and includes a radiolucent limb support.

I claim:

1. A height-adjustable device for supporting a lower limb or a body portion of a patient during operation of a fractured bone, to be attached to an operation table, the device comprising:

a jack configured to be raised to a position at a required height and to be secured in this position, said jack having a top which is secured to a limb support made of a material transparent to X-Ray and to other radiation used by photo imaging apparatus, wherein said jack is positioned toward a side of said limb support such that said jack does not block radiation from passing between a portion of the photo imaging apparatus, positioned underneath said limb support, and the body portion or the limb supported by said limb support, said jack being adapted for positioning said limb support underneath the body portion or limb to be supported at a required angular alignment, a substantially horizontal bar having a body and two ends, one end thereof being firmly connected to said jack and another end spaced from said jack, and a bracket for securing said body of said bar to a clamp connector slidingly attached to a side rail of the operation table, said bracket being firmly attached to the clamp connector by an arrangement permitting swinging thereof in a horizontal plane so that the bracket can be secured at any angular alignment, said bracket being provided with a locking device for securing said bar in a desired position in said bracket so that the lower limb or the lower body portion of a patient is supported by said limb support.

2. The device of claim 1, wherein said bar has an identical circular cross section throughout.

3. The device of claim 2, wherein:

said bracket has a shape of a cylinder with a bore having a diameter coextensive with the diameter of said bar, said bracket is transversely slotted in a lower portion thereof, thereby dividing said bracket into a central portion and two lateral portions, with the central portion being longitudinally slotted, said slot being adapted to be narrowed by lugs on opposite sides of said slot pulled towards each other by a screw, thereby clamping said bracket onto said bar, and said bracket is provided with a cylindrical rod of a size fitting into a clamping bore of said clamp connector, said rod extending from said bracket in an upward direction.

4. The device of claim 2, wherein:

said bracket has a shape of a short cylinder with a bore having a diameter coextensive with the diameter of said bar, said bracket is longitudinally slotted, said slot being adapted to be narrowed by lugs on opposite sides of said slot pulled towards each other by a screw, thereby clamping said bracket onto said bar, and said bracket is provided with a cylindrical rod of a size fitting into a clamping bore of said clamp connector, said rod extending from said bracket in an upward direction.

5. The device of claim 1, wherein said bar is a tube of identical cross section throughout.

6. The device of claim 5, wherein:

said bracket has a shape of a short cylinder with a bore having a diameter coextensive with the diameter of said tube, said bracket is transversely slotted in a lower portion thereof, thereby dividing said bracket into a central portion and two lateral portions, with the central portion being longitudinally slotted, said slot being adapted to be narrowed by lugs on opposite sides of said slot pulled towards each other by a screw, thereby clamping said bracket onto said tube, and said bracket being provided with a cylindrical rod of a size fitting into a clamping bore of said clamp connector, said rod extending from said bracket in an upward direction.

7. The device of claim 5, wherein:

said bracket has a shape of a short cylinder with a bore having a diameter coextensive with the diameter of said tube, said bracket is longitudinally slotted, said slot being adapted to be narrowed by lugs on opposite sides of said slot pulled towards each other by a screw, thereby clamping said bracket onto said tube, and said bracket is provided with a cylindrical rod of a size fitting into a clamping bore of said clamp connector, said rod extending from said bracket in an upward direction.

8. The device of claim 1, wherein said jack includes:

a jack housing provided with a vertical bore closely surrounding a ratchet in the form of a cylindrical bar having spaced apart circumferential slots, said ratchet supporting said limb support at a top end thereof in horizontal firm fixation, and a pawl mounted on said housing and configured to engage with one of said slots to hold said ratchet and said limb support at the required height and in the required angular alignment.

9. The device of claim 8, wherein:

said jack housing is vertically slotted, and said slot is adapted to be narrowed and to be clamped onto said ratchet by a lug on either side of said slot to be pulled together by a screw extending through said lugs.

10. The device of claim 1, wherein:

said jack includes a jack housing provided with a vertical bore closely surrounding a cylindrical bar supporting said limb support in horizontal firm, angularly adjustable fixation and a horizontal bore, and said bar is provided with a plurality of lengthwise spaced apart bores, and said cylindrical bar and said limb support are secured at the required height by a pin inserted through said horizontal bore in said housing into one of said bores in said bar.

11. The device of claim 1, wherein said jack includes:

a jack housing provided with a vertical bore closely surrounding a screw, the screw supporting said limb support at a top end thereof in firm horizontal fixation, and a screw nut mounted on said screw in contact with a top of said housing, permitting raising said screw and said limb support by manually turning said nut and permitting said screw and said limb support to be swung about a full circle to fit underneath the limb to be supported.

12. The device of claim 1, wherein:

said jack includes a jack housing provided with a vertical bore closely surrounding a cylindrical bar supporting said limb support in firm fixation, and said housing is vertically slotted and configured to be clamped onto said bar by means of lugs on each side of said slot adapted to be pulled together by a screw.

13. The device of claim 12, wherein:

said jack housing is vertically slotted, and said slot is adapted to be narrowed and to be clamped onto said screw by a lug on either side of said slot to be pulled together by a screw extending through said lugs.

14. A height-adjustable device for supporting a lower limb or a body portion of a patient during operation of a fractured bone, to be attached to an operation table, the device comprising:

a jack configured to be raised to a position at a required height and to be secured in this position, said jack having a top which carries a limb support of a material transparent to X-Ray and to other radiation used in photo imaging, said jack being adapted for positioning said limb support underneath the body portion or limb to be supported at a required angular alignment;

a substantially horizontal bar having a body and two ends, one end thereof being firmly connected to said jack and another end spaced from said jack; and a bracket for securing said body of said bar to a clamp connector slidingly attached to a side rail of the operation table, said bracket being firmly attached to the clamp connector by an arrangement permitting swinging thereof in a horizontal plane so that the bracket can be secured at any angular alignment, said bracket being provided with a locking device for securing said bar in a desired position in said bracket so that the lower limb or the lower body portion of a patient is supported by said limb support;

wherein said bar has an identical circular cross section throughout; and wherein:

said bracket has a shape of a short cylinder with a bore having a diameter coextensive with the diameter of said bar, said bracket is longitudinally slotted, said slot being adapted to be narrowed by lugs on opposite sides of said slot pulled towards each other by a screw, thereby clamping said bracket onto said bar, and said bracket is provided with a cylindrical rod of a size fitting into a clamping bore of said clamp connector, said rod extending from said bracket in an upward direction.

15. A height-adjustable device for supporting a lower limb or a body portion of a patient during operation of a fractured bone, to be attached to an operation table, the device comprising:

a jack configured to be raised to a position at a required height and to be secured in this position, said jack having a top which carries a limb support of a material transparent to X-Ray and to other radiation used in photo imaging, said jack being adapted for positioning said limb support underneath the body portion or limb to be supported at a required angular alignment;

a substantially horizontal bar having a body and two ends, one end thereof being firmly connected to said jack and another end spaced from said jack; and a bracket for securing said body of said bar to a clamp connector slidingly attached to a side rail of the operation table, said bracket being firmly attached to the clamp connector by an arrangement permitting swinging thereof in a horizontal plane so that the bracket can be secured at any angular alignment, said bracket being provided with a locking device for securing said bar in a desired position in said bracket so that the lower limb or the lower body portion of a patient is supported by said limb support;

wherein said bar is a tube of identical cross section throughout; and wherein:

said bracket has a shape of a short cylinder with a bore having a diameter coextensive with the diameter of said tube, said bracket is longitudinally slotted, said slot being adapted to be narrowed by lugs on opposite sides of said slot pulled towards each other by a screw, thereby clamping said bracket onto said tube, and said bracket is provided with a cylindrical rod of a size fitting into a clamping bore of said clamp connector, said rod extending from said bracket in an upward direction.

16. A height-adjustable device for supporting a lower limb or a body portion of a patient during operation of a fractured bone, to be attached to an operation table, the device comprising:

a jack configured to be raised to a position at a required height and to be secured in this position, said jack having a top which carries a limb support of a material transparent to X-Ray and to other radiation used in photo imaging, said jack being adapted for positioning said limb support underneath the body portion or limb to be supported at a required angular alignment;

a substantially horizontal bar having a body and two ends, one end thereof being firmly connected to said jack and another end spaced from said jack; and a bracket for securing said body of said bar to a clamp connector slidingly attached to a side rail of the operation table, said bracket being firmly attached to the clamp connector by an arrangement permitting swinging thereof in a horizontal plane so that the bracket can be secured at any angular alignment, said bracket being provided with a locking device for securing said bar in a desired position in said bracket so that the lower limb or the lower body of a patient is supported by said limb support;

wherein said jack includes:

a jack housing provided with a vertical bore closely surrounding a screw, the screw supporting said limb support at a top end thereof in firm horizontal fixation, and a screw nut mounted on said screw in contact with a top of said housing, permitting raising said screw and said limb support by manually turning said nut and permitting said screw and said limb support to be swung about a full circle to fit underneath the limb to be supported.

17. The device of claim 6, wherein:

said jack housing is vertically slotted, and said slot is adapted to be narrowed and to be clamped onto said screw by a lug on either side of said slot to be pulled together by a screw extending through said lugs.

18. A height-adjustable device for supporting a lower limb or a body portion of a patient during operation of a fractured bone, to be attached to an operation table, the device comprising:

a jack configured to be raised to a position at a required height and to be secured in this position, said jack having a top which carries a limb support of a material transparent to X-Ray and to other radiation used in photo imaging, said jack being adapted for positioning said limb support underneath the body portion or limb to be supported at a required angular alignment;

a substantially horizontal bar having a body and two ends, one end thereof being firmly connected to said jack and another end spaced from said jack; and a bracket for securing said body of said bar to a clamp connector slidingly attached to a side rail of the operation table, said bracket being firmly attached to the clamp connector by an arrangement permitting swinging thereof in a horizontal plane so that the bracket can be secured at any angular alignment, said bracket being provided with a locking device for securing said bar in a desired position in said bracket so that the lower limb or the lower body portion of a patient is supported by said limb support; and wherein:

said jack includes a jack housing provided with a vertical bore closely surrounding a cylindrical bar supporting said limb support in firm fixation, and said housing is vertically slotted and configured to be clamped onto said bar by means of lugs on each side of said slot adapted to be pulled together by a screw.

* * * * *